US011333460B2

(12) United States Patent
Wutte et al.

(10) Patent No.: US 11,333,460 B2
(45) Date of Patent: May 17, 2022

(54) FIREARM WITH IMPROVED BARREL CONNECTION

(71) Applicant: GLOCK TECHNOLOGY GMBH, Ferlach (AT)

(72) Inventors: Andreas Wutte, Ferlach (AT); Elmar Bilgeri, Steyr (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 100 days.

(21) Appl. No.: 17/026,027

(22) Filed: Sep. 18, 2020

(65) Prior Publication Data

US 2021/0164750 A1 Jun. 3, 2021

(30) Foreign Application Priority Data

Oct. 4, 2019 (EP) ..... 19201455

(51) Int. Cl.
*F41A 21/48* (2006.01)

(52) U.S. Cl.
CPC ..... *F41A 21/484* (2013.01); *F41A 21/487* (2013.01)

(58) Field of Classification Search
CPC ..... F41A 21/48; F41A 21/484; F41A 21/485; F41A 21/487; F41A 11/00; F41A 11/02; F41C 7/11
See application file for complete search history.

(56) References Cited

U.S. PATENT DOCUMENTS 1,467,159 A * 9/1923 Heine ..... F41A 21/484 89/37.07
2,455,608 A * 12/1948 Rosengren ..... F41A 21/484 42/75.01
2,817,174 A * 12/1957 Liedke ..... F41A 21/484 42/75.02
5,410,834 A * 5/1995 Benton ..... F41A 21/482 42/75.02
6,487,805 B1 * 12/2002 Reynolds ..... F41A 21/485 42/75.03
7,313,883 B2 1/2008 Leitner-Wise
(Continued)

FOREIGN PATENT DOCUMENTS

DE 19815261 A1 * 12/1999 ..... F41A 11/00
DE 102009051416 A1 7/2010
(Continued)

OTHER PUBLICATIONS

European Search Report, Appl. No. EP 19 20 1455, completed Mar. 11, 2020.

*Primary Examiner* — Gabriel J. Klein
(74) *Attorney, Agent, or Firm* — Raven Patents, LLC; Anton E. Skaugset

(57) ABSTRACT

Firearms, particularly rifles, including an upper housing having a barrel, where the barrel and the upper housing are interconnected by means of a guide. In order to improve the connection, the guide includes corresponding prismatic guide surfaces that extend in parallel with the barrel shaft when the firearm is mounted and ready to fire, and the barrel is secured to the upper housing by a tensioning element that can rotate in the upper housing about an axis of rotation that extends normally with respect to the firearm center plane, and the tensioning element includes a tensioning portion and an actuating portion.

23 Claims, 12 Drawing Sheets

(56) References Cited

U.S. PATENT DOCUMENTS

| | | | | |
|---|---|---|---|---|
| 7,823,314 | B1 * | 11/2010 | Wheatley | F41A 21/484 89/14.4 |
| 8,813,406 | B1 | 8/2014 | Sullivan | |
| 8,881,444 | B2 * | 11/2014 | Warburton | F41C 23/00 42/74 |
| 8,973,483 | B2 | 3/2015 | Sullivan | |
| 9,038,525 | B2 | 5/2015 | Sullivan | |
| 9,228,786 | B2 | 1/2016 | Sullivan | |
| 9,488,423 | B2 | 11/2016 | Sullivan | |
| 10,704,852 | B2 * | 7/2020 | Michut | F41A 11/02 |
| 2010/0281742 | A1 * | 11/2010 | Barrett | F41A 21/487 42/75.02 |
| 2015/0308779 | A1 | 10/2015 | McGinty | |
| 2020/0309477 | A1 * | 10/2020 | Bennink | F41A 11/00 |

FOREIGN PATENT DOCUMENTS

| | | | | |
|---|---|---|---|---|
| DE | 202011100433 | U1 * | 10/2011 | F41A 21/48 |
| DE | 102010000617 | A1 | 2/2012 | |
| DE | 202012101602 | U1 | 6/2012 | |
| DE | 102011114686 | B3 | 3/2013 | |
| EP | 1345001 | A1 * | 9/2003 | F41A 21/484 |
| EP | 1574806 | A1 * | 9/2005 | F41A 11/00 |
| EP | 2363678 | A2 | 4/2016 | |
| EP | 2913622 | A1 | 11/2016 | |
| FR | 386646 | A | 6/1908 | |
| FR | 412523 | A | 7/1910 | |
| GB | 190901954 | A | 1/1910 | |

* cited by examiner 1
3
A
A
23
19
18
21
5; 51

IV
A-A
3
25
22
28
19
20
18
1
26

1
5;52
21b
19
C
C
3
18
23
21a
5; 51

C-C
VIII
25
22
5; 51
28
5;52
19
3
20
18
1
26

FIREARM WITH IMPROVED BARREL CONNECTION

TECHNICAL FIELD

The present disclosure relates to firearms, particularly long guns, and more specifically to the the connection between the barrel and the upper part of the firearm.

BACKGROUND

In recent years, there has been an increasing need within the military and the police for the ability to readily change the barrel of a firearm without a large amount of effort. In this way a firearm can be rapidly fitted with a barrel having a different length, or a barrel having a different caliber, for example, when needed, while the barrel butt, the bore, maintains its position in the upper part at every caliber. In the latter case, modifications may also have to be made to the lower part of the firearm, but this is not relevant to the subject matter of the present disclosure.

Previous attempts have been made to address barrel interchangeability, such as are described in the following references:

FR 412 523 of 1909 discloses a pistol with a so-called "fixed barrel" barrel which may be dismounted along a guide after a rotatable block in front of it has been turned around an axis which is orientated parallel to the barrel axis. However, the disclosure provides no provision to ensure that the chamber is empty or anything else.

FR 386 646 of 1908, published under GB 1909 01954 A discloses a similar system, in which the block is rotated around a vertical axis and the barrel is taken off after some movement along the guides by tilting without given axis around its front part. This solution possesses the same disadvantages as the example provided above.

EP 2 363 678, corresponding to DE 10 2010 000 617, proposes connecting the barrel to a locking bushing, for example by means of a thread. The locking bushing fits in a circular cylindrical bore in the housing (upper part) and is secured by means of a rotary eccentric. During the disassembly process a front part of the bolt, called the bolt head, is removed from the housing together with the barrel, making it difficult to change the barrel. The circular cylindrical bearing of the barrel, the angular position of which is only determined by a flat portion that interacts with the eccentric, which portion is never precise, and the "entrainment" of the bolt head are extremely disadvantageous and soon leads to wear and noticeable inaccuracies occurring during use under harsh conditions.

EP 2 663 826, corresponding to U.S. Pat. Nos. 9,228,786, 8,813,406, 8,973,483, 9,038,525 and 9,488,423 (each of which, along with GB 1909 01954 A, are hereby incorporated by reference), each include over 140 pages with over 80 figures, most of which are still divided into views A-F, and disclose a connection of a barrel to a "backbone", which is arranged thereabove, by means of a lever (this can be best seen in FIG. 52A-53C). The lever consists of two brackets, which are arranged in parallel with the firearm center plane on the left and the right of the backbone, and are interconnected by means of a ridge, which is also used as a shaft. The backbone includes an indentation on its upper side, which extends transversely to the barrel shaft, on or in which the ridge is placed from above. The upper side of the barrel includes a point of engagement for the lever on the left- and right-hand side, which point also comprises a prismatic indentation and, when the lever is pulled, is pressed against the circular cylindrical lateral face of the backbone. The mounting movement between the barrel and the backbone only takes place normally with respect to the barrel shaft, which is ensured by two additional points of contact that are axially in front of and behind the lever.

In the mounted state the barrel and backbone therefore have three points of contact with one another. The relative position of the two components is set by the indentation for the ridge, the contact between the prism, which is a few millimeters long, and the cylindrical casing of the backbone, and by the two other contact points, which are purely interlocking and therefore tolerance-dependent. During operation under harsh conditions, such a structure is not able to reliably and repeatedly reach an accurate position, creating a risk of the lever getting lost since it is a loose and not particularly large component part.

U.S. Pat. No. 7,313,883 (hereby incorporated by reference) proposes that the barrel together with the sights attached thereto and attachments that may be mounted thereon (laser, light, etc.) is held on the housing by means of a mounting part that is rigidly connected to the barrel and is optionally integral therewith. Said barrel is held by means of two opposite toggle joints, which clamp matching surfaces of the mounting part between them. In this case, particular emphasis should be placed on the fact that the barrel is mounted in a "free floating" manner, its position therefore being determined by the forces that are created by the two levers. This is apparently sufficient for "Squad Assault Weapons (SAW)", which are taken into consideration and are used at the closest range, but not for other fields of application.

US 2010/281742 (hereby incorporated by reference) proposes a possible way of removing the barrel of a rifle that is similar to that in the first document mentioned: a circular cylindrical receptacle comprising a securing toggle joint and therefore exhibits all of the same problems resulting therefrom.

DE 10 2011 114 686, DE 20 2012 101 602 U and EP 2 913 622 each disclose a slightly different way of clamping the barrel, which has a circular cylindrical outer contour, in a slotted bush having a circular cylindrical inner contour, bringing about a purely non-positive and therefore non-reproducible position.

US 2015/308779 (hereby incorporated by reference) discloses mounting a barrel in a circular cylindrical ring in the housing, whereby a flange of the barrel is pushed backwards by a kind of flap on the lower side of the housing when said flap is closed, and the lower side and lateral regions in the rear portion of the barrel are secured by corresponding side parts of the flap. In this case, too, the accuracy with which the lower side and lateral regions are coupled is insufficient, particularly when all the components are significantly heated, as mentioned.

All the known previously known solutions are therefore associated with disadvantages, which in particular include barrel positioning that cannot be maintained during use, or when heated, and most commonly the risk of losing small parts such as fixing bolts or screws. There is therefore a need for a reliable, accurate, reproducible, simple, and robust solution to the problem of changing the barrel in an upper part of a rifle.

SUMMARY

The present disclosure relates to the upper part of a firearm, which includes at least a barrel, a bolt mechanism, a firing pin mechanism, and optionally further includes a gas mechanism and a cover. This upper part is removably connected to a lower part, which includes at least a butt, a magazine and a trigger mechanism. The trigger mechanism is operatively connected to the firing pin mechanism in the assembled ready-to-fire state of the firearm. In detail, the present disclosure relates to the attachment of the barrel to the upper part of the firearm.

The present disclosure can include a firearm having an upper housing including at least one barrel having a barrel shaft, a bolt mechanism, a firing pin mechanism, and a cover; and a lower housing including at least one butt, a magazine, and a trigger mechanism. When the firearm is in an assembled and ready-to-fire state the upper housing and the lower housing are interconnected, the trigger mechanism is operatively connected to the firing pin mechanism, and the barrel is detachably arranged in the upper housing, provided that the barrel and a carrier are interconnected by means of a guide having prismatic guide surfaces that extend in parallel with the barrel shaft when the firearm is mounted in the ready-to-fire state, further provided that the barrel is secured to the upper housing by means of a tensioning element that can rotate in the upper housing between a first end position that is a ready-to-fire position and a second end position that is a disassembled position, the tensioning element rotating about an axis of rotation that extends orthogonally with respect to a center plane of the firearm, and yet further provided that when the firearm is in the ready-to-fire state, a tensioning portion of the tensioning element rests against a stop surface of the barrel, and when the firearm is in a fieldstripped position, the tensioning portion of the tensioning element lies entirely outside a motion path of the barrel.

Selected features, functions, and advantages may be achieved independently in various embodiments of the present disclosure, further details of which can be seen with reference to the following description and drawings.

DETAILED DESCRIPTION

Figure 1:
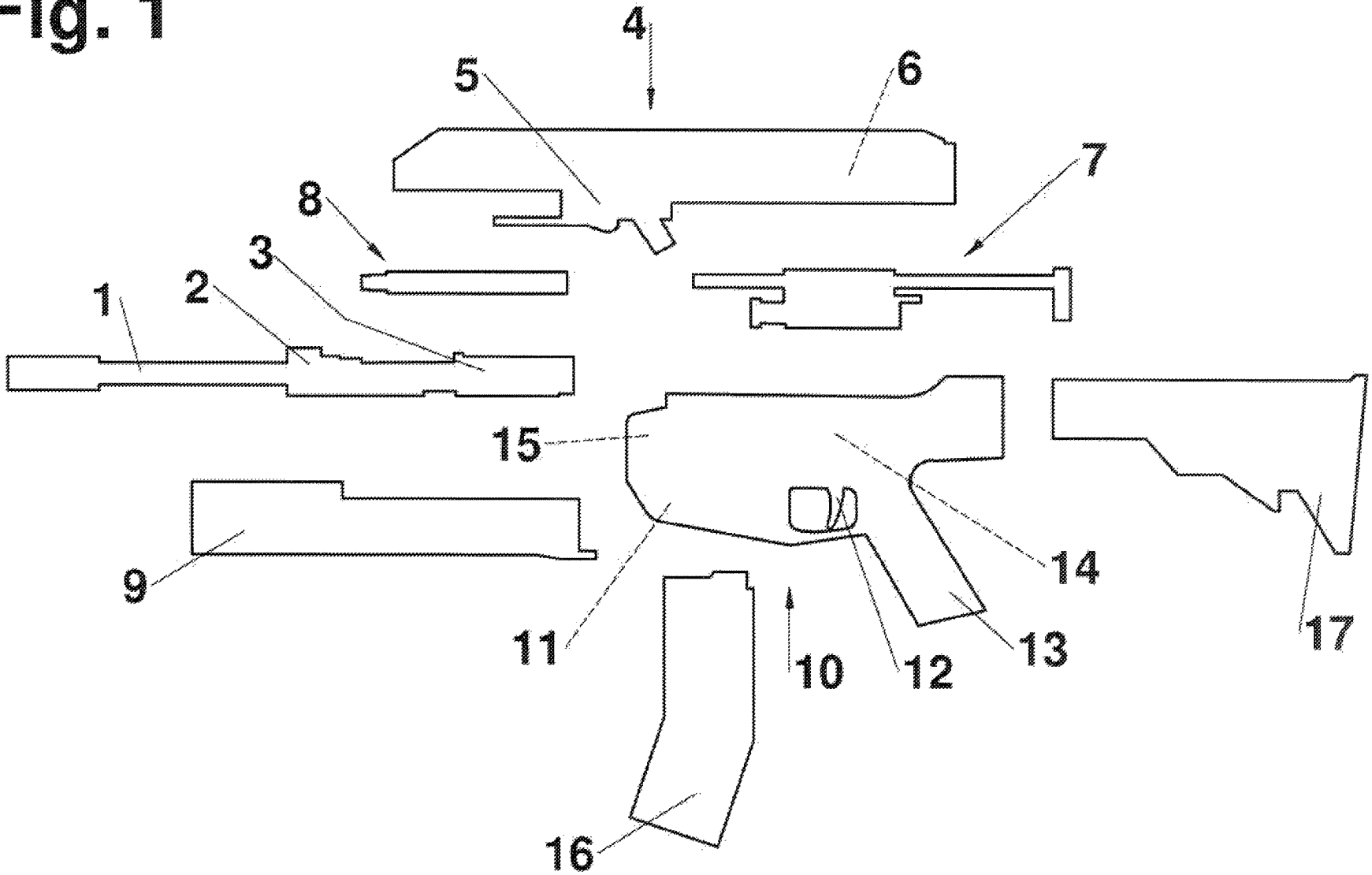
FIG. 1 is a purely schematic view of the individual components of a rifle, which can be designed in accordance with the present disclosure.

According to the present disclosure, a solution to the problem of changing the barrel in an upper part of a rifle is achieved by a firearm that comprises a barrel, which optionally includes a locking bush that is rigidly connected to the barrel, on the one hand and the upper part of the rifle or a carrier arranged in the upper part on the other hand, corresponding guides, preferably prismatic guide surfaces, which extend in parallel with the barrel shaft in the mounted ready-to-fire state; and, after having been inserted by means of the guides, the barrel is secured on the upper part, using a locking element or a tensioning element, possibly in the form of a cam, which is provided on the upper part; and a force acts on the barrel, optionally the locking bush, in the firearm center plane and normally with respect to the movement direction, or interlockingly secures said barrel.

The terminus "corresponding guides" stands for the totality of all interacting surfaces, one set of surfaces on the barrel (or a part fixedly connected with it), the other set of surfaces on the upper housing (or a part fixedly connected with it). These two sets which allow a guided movement of the barrel relative to the upper housing comprise (or constitute) the "corresponding guides" mentioned above.

The barrel shaft is "in the mounted, ready-to-fire state" because under certain circumstances the barrel changes its position during mounting or firing. The locking bush can be releasably connected to the barrel, for example by a thread, or permanently connected to the barrel.

Reference to the firearm center plane should be readily understood in the conventional sense, and corresponds to a plane that extends vertically through the barrel shaft along the center line of the firearm, when in the standard firing position.

Within the present description and in the claims, the term "firearm" can refer to any repeating firearm, long gun, rifle, carbine, and the like without limitation.

After having been successfully inserted from the front, the barrel and/or the locking bush rests on a catch, shoulder, stop surface or similar part of the upper housing. The purpose of securing the barrel and/or the locking bush is to hold the barrel in this position and, if the barrel and/or caliber is/are changed, to move said barrel into the intended position of the barrel shaft in a manner that can be accurately reproduced, where it is secured. The external dimensions of the barrel or optionally the locking bush are therefore determined by the dimensions of the upper housing, whereby, having knowledge of the disclosure, a person skilled in the art can accordingly provide the guides on the barrel or locking bush to the carrier and/or upper housing.

The locking element or tensioning element can also additionally exert a force component on the barrel in the movement direction (direction of the barrel shaft) (in order to avoid prolixity, in the following reference will only be made to the locking bush where necessary), but this is less essential to the essence of the disclosure than the force that is normal with respect to the barrel shaft. The tensioning element comprises a tensioning portion, which is preferably formed as a cam and is preferably rotated about the shaft in the upper housing, transversely to the barrel shaft, by means of a lever-shaped actuating portion, to which it is rigidly connected or with which it is integral.

The guides are preferably prismatic guides, that is guides comprising planar contact surfaces that are oriented in parallel with the barrel shaft and (only) allow the parts to move with respect to one another in this direction. They are therefore referred to as "prismatic" because they constitute parts of the lateral surface of a prism. They are particularly preferably dovetail guides, which allow for particularly accurate and reproducible positioning. Either one such guide is provided or, preferably, a pair of guides, which is/are arranged symmetrically to the firearm center plane in order to achieve the best possible guidance. Despite the accuracy of the prismatic guides, the action of the tensioning element or the cam is intended to have a centering effect on the barrel or locking bush due to the angular position of the prisms, as this further improves the positioning reproducibility.

The tensioning portion is preferably part of a lever, which is mounted in the upper housing (upper) or in a carrier provided therefor, below the barrel, such that it can rotate about an axis of rotation that extends normally with respect to the firearm center plane. In order to increase the efficacy and the contact pressure, the tensioning element is preferably in contact with the barrel over the entire available width thereof if possible, for which purpose the guides in the upper housing or carrier can be interrupted at this point when they are provided below the barrel in the region of the tensioning element. In an alternative embodiment, a toggle or the like can also be provided, which is arranged on the side of the barrel and is connected to the tensioning element.

An embodiment in which the barrel comprises a flat portion on its lower side in the region of the receptacle in the upper housing and/or the locking bush is also preferable, which flat portion allows for interaction with the tensioning portion over a defined surface area, thereby further increasing the repeatability of the position.

According to the disclosure, the guides that are used to receive the barrel (and/or the locking bush) can be formed in or on a carrier, which is connected to or fastened on the upper housing such that it cannot move. Such an arrangement is understood as being "housing-mounted". Alternatively, the guides can also be directly provided in the upper housing (upper), whereby a separate carrier can either be completely omitted and therefore the carrier is integral with the upper housing, or this carrier is fixedly connected to the upper housing, as would be the case in a carrier which is overmolded with plastics material, for example.

As can be seen from FIG. 1, in a correspondingly functional view comprising all its equipment, a rifle comprises a barrel 1, a gas drive 2, a locking bush 3, an upper housing 4, in most cases also referred to as an upper outside of the USA, a carrier 5, which in turn comprises guides 6 for a bolt 7 and/or a cocking slide 8 and/or other functional elements, a fore-end 9, a lower housing, also referred to as a lower 10, which in turn comprises a magazine holder 11, a firing device 12, a butt 13 and a slide stop device 14, a central lock 15, a magazine 16 and a stock 17, for example.

All of these parts do not always have to be provided or the design of which can differ slightly depending on the application, for example in hunting weapons; however, additional parts may conversely also be provided, for example mounting elements for telescopic sights, laser pointers, and so on and so forth. Some of said components can also be collectively formed on a more complex component such that they cannot be separated from one another, such as the lower housing or lower 10 in the present case, so that the view only constitutes an example of a very modular rifle.

Figure 2:
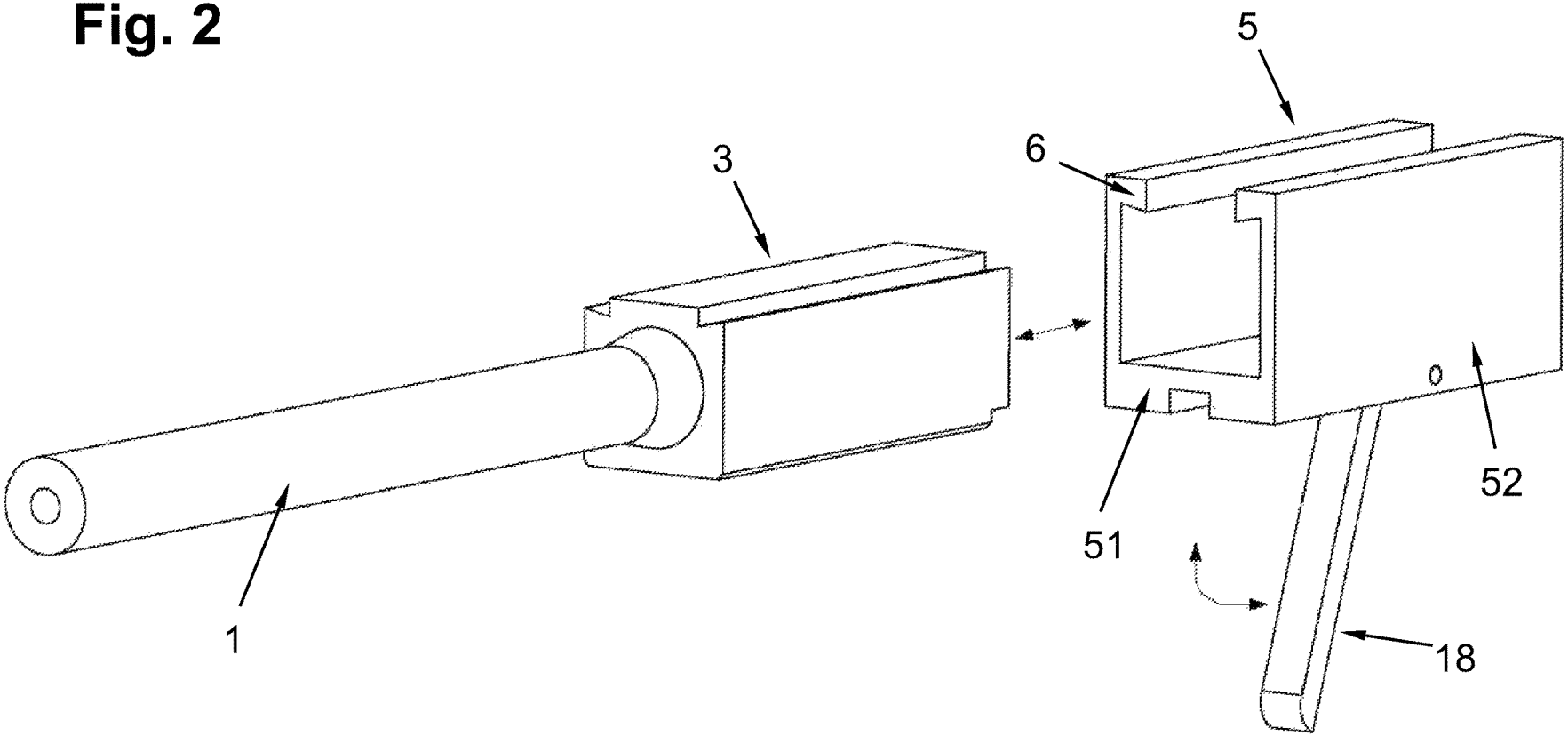
FIG. 2 is a perspective view, which is likewise purely schematic, of a barrel comprising a carrier having guides according to the present disclosure.
Figures 3, 4:
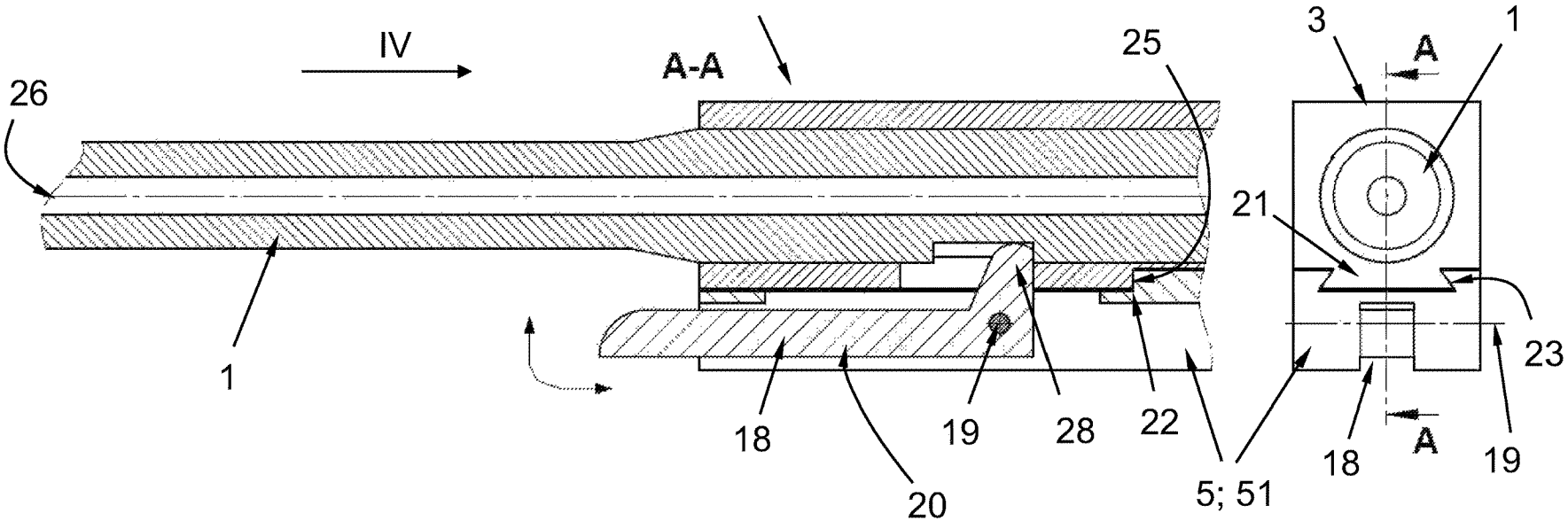
FIG. 3 is a cross-sectional view of a firearm according to the present disclosure, as indicated in FIG. 4.
FIG. 4 is a front view of the firearm of FIG. 3.

FIG. 2 is a purely schematic perspective view of the barrel 1, comprising a locking bush 3 in front of the support 5, into which said barrel can be inserted in the direction of the double-headed arrow, which extends in parallel with the barrel shaft 26 (FIG. 3). For this purpose, corresponding guides 6 are provided on the locking bush 3 and in the carrier 5, which are prismatic, i.e. the contact surfaces are planar. In order to allow for movement along the double-headed arrow, the planes extend in parallel with the double-headed arrow. In the embodiment shown, the carrier 5 comprises a frame 52 comprising a carrier plate 51, which surrounds the locking bush 3. An actuating portion 18, in the form of a lever here, is arranged in the carrier 5 so as to be rotatable about an axis of rotation 19.

In the selected embodiment the carrier 5 is formed as one part, although, according to the disclosure, carriers 5 composed of a frame 52 and carrier plate 51 can also be used. Likewise, the guides 6 can also be formed on the carrier plate 51 and/or the frame 52.

The bolt 7 and the firing pin mechanism are not shown, as they are not particularly relevant to the present disclosure. Similarly, the associated lower part 10 of the firearm is not shown either as it has little relevance to the present disclosure.

By viewing FIG. 2 together with FIG. 1, it can be seen that a carrier 5 does not necessarily have to be formed separately and fastened in the upper housing 4, but the carrier 5 or the guides 6 can also be integrally formed in the upper housing 4, and therefore a separate view has been omitted here.

FIG. 3-10 are each a schematic front view of a section through the firearm center plane showing four different embodiments of the guides or the tensioning mechanism. Even now, it should be noted that any of the individual variants of the tensioning mechanism can be combined with any of the individual variants of the guides.

FIG. 3-4 constitute a first possible embodiment, in which the guides 6 are in the form of a dovetail. FIG. 3, which is a section through the firearm center plane 30, shows in particular the formation of a tensioning element 20 in the upper housing. As can be seen in FIG. 4, the guides 6 are formed on the carrier plate 51. In the mounted position shown, the tensioning element 20 that is formed as a cam, presses the locking bush 3 of the barrel 1 upwards so that the contact pressure is exerted on the corresponding oblique guide surfaces 23 of the dovetail. In addition to geometric guidance, this leads to a centering as a consequence of the forces being exerted and thus doubly ensures the desired accurate position. Furthermore, in this embodiment a planar axial stop surface 22 of the carrier 5, which faces the rear in the position shown, rests against a front 25 of the locking bush 3 and therefore interlockingly secures the barrel 1 in the axial direction by means of the axial stop surface 22 and ultimately non-positively secures said barrel, again in the axial direction, by means of the contact pressure. The tensioning element 20 and the fact that it is borne about the axis of rotation 19 in the carrier 5, which also comprises the mating surfaces of the dovetail of the guides 6, is clearly shown, albeit schematically. The guides are interrupted in the region of the axis of rotation 19 in order to create space for the tensioning element 20.

"Interlocking" relates to the way in which the geometry of the surfaces shown match, but should not be understood in a purely geometrical and mathematical sense, since the positive fit has to take into account vibrations, thermal expansions, impacts, etc. and therefore also always have an axially oriented force component. In this case, as a result of the discontinuation of any movement whatsoever of the barrel in the axial direction in the event of an emergency, which discontinuation is, however, always interlocking, said positive fit is referred to as "interlocking" here.

FIG. 4, which is a schematic front view in the direction of the arrow IV in FIG. 3, is a detailed view of the orientation of the oblique guide surfaces 23 of the prismatic guide and the centering element 21, which interacts with said guide surfaces, with respect to the barrel shaft 26. In the present embodiment, a single-part centering element 21 is shown.

Figure 6:
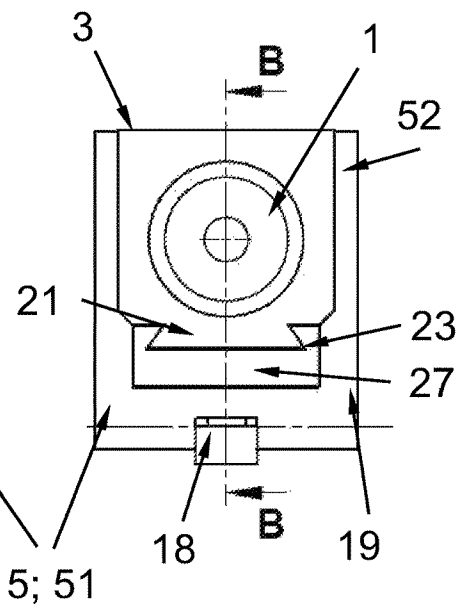
FIG. 6 is a front view of the firearm of FIG. 5
Figure 5:
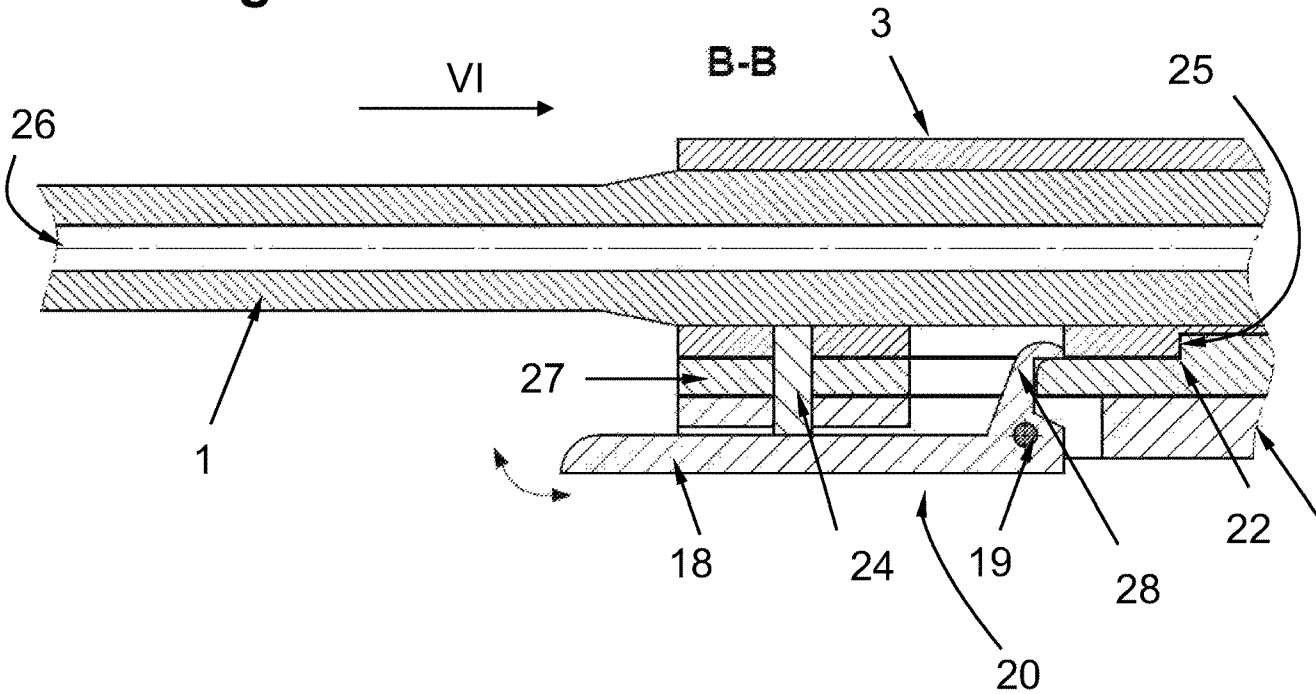
FIG. 5 is a cross-sectional view of a firearm according to the present disclosure, as indicated in FIG. 6.

In the same views shown in FIG. 3-4, FIG. 5-6 show a variant in which the guides 6 are in the form of a plurality of guide surfaces 23. The functional principle of this embodiment is aimed at axially securing the barrel and the locking bush 3 by means of a tensioning element 20 in a similar way to in the previous example. The tensioning portion 28 shown in FIG. 5-6 is formed as a claw-shaped or hook-shaped cam in this case, and therefore tensile stress is downwardly applied to an intermediate piece 27, transversely to the barrel shaft 26 (lying in or symmetrically to the firearm center plane 30), by the tensioning elements 20 in the closed state. The carrier 5, which is shown by way of example, is therefore likewise used to receive the intermediate piece 27, as a result of which the locking bush 3 and therefore the barrel 1 are interlockingly and non-positively connected to the upper housing 4 when a force is applied by means of the tensioning element 20 in a similar way to in the previous example.

In addition, for improved support of the barrel 1 during "downward" tensile stress, a counter pusher 24 can be provided, which is arranged mounted on the housing of the upper housing 4 or of the lever-shaped actuating portion 18, passing through the locking bush 3, or of the locking bush 3 itself.

Figure 8:
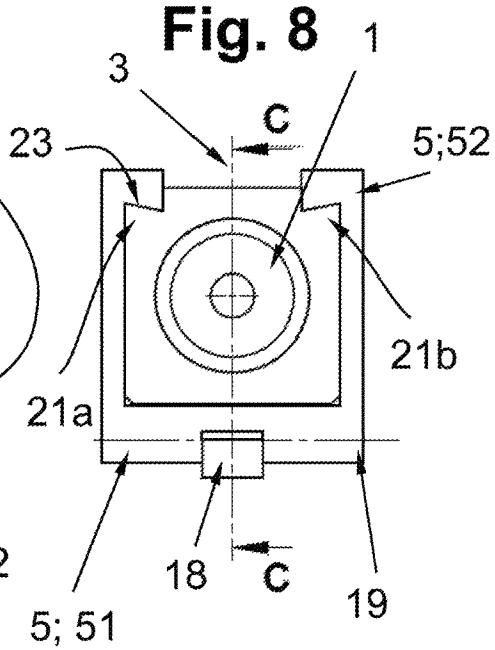
FIG. 8 is a front view of the firearm of FIG. 7
Figure 7:
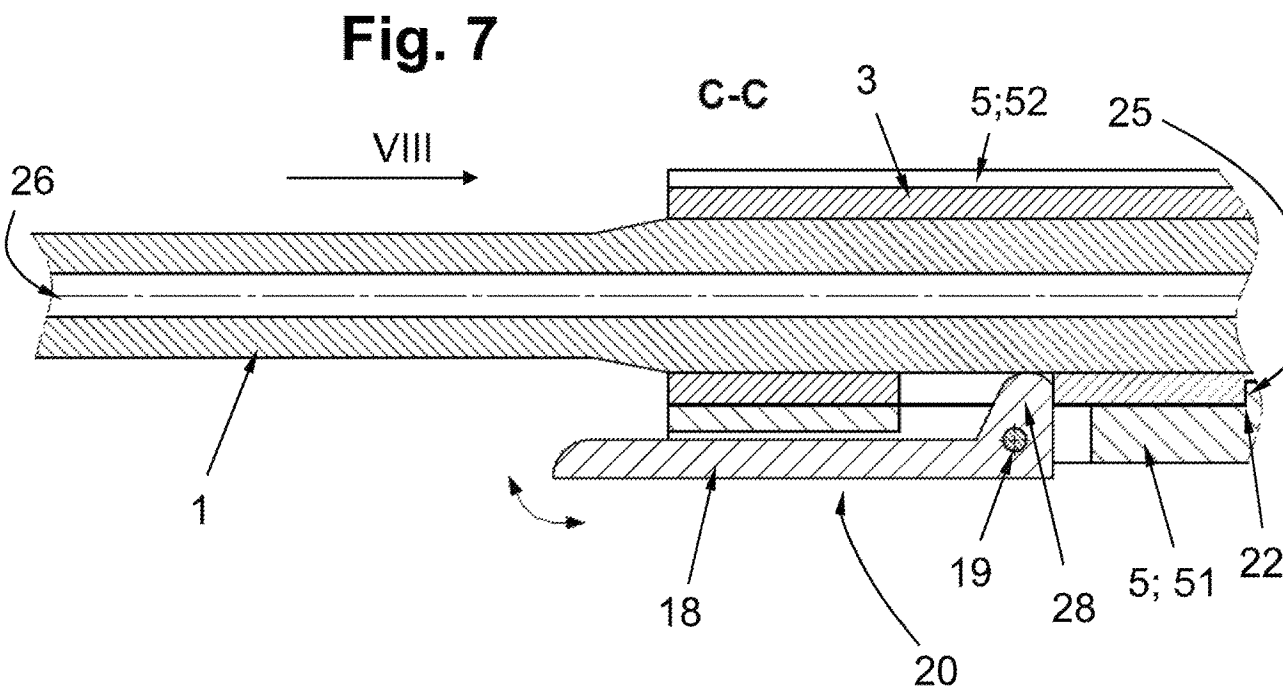
FIG. 7 is a cross-sectional view of a firearm according to the present disclosure, as indicated in FIG. 8.

FIG. 7-8 show a variant in which the dovetail-like prismatic guide 6 is arranged above the barrel shaft 26, where said shaft can be formed so as to be continuous without any problems. The cam-like tensioning portion 28 in turn ensures securing in the axial direction and normally with respect thereto in a similar way to in the above-described variant in FIG. 3-4. In these variants, the centering element 21 is divided into two sub-elements 21*a*, 21*b*, which are formed so as to have a complementary shape and function to the guide surfaces 23 on the upper side of the locking bush 3.

A comparison of FIG. 3 with FIGS. 5 and 7 clearly shows that, irrespective of the selected embodiment and position of the guide 6 or the design of the carrier 5, the barrel 1—the locking bush 3—can comprise a recess in its lower side. This recess can serve as an additional support point or stop surface for the tensioning element 20 or the tensioning portion 28, thereby further improving the repeatable positioning of the barrel 1 inside the upper housing 4 and the barrel 1 is additionally tensioned together with the locking bush 3 and the upper housing 4.

Figure 10:
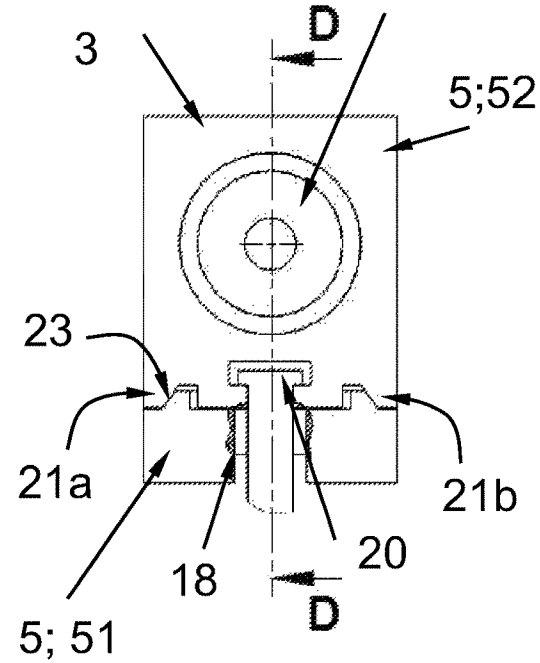
FIG. 10 is a front view of the firearm of FIG. 9.
Figure 9:
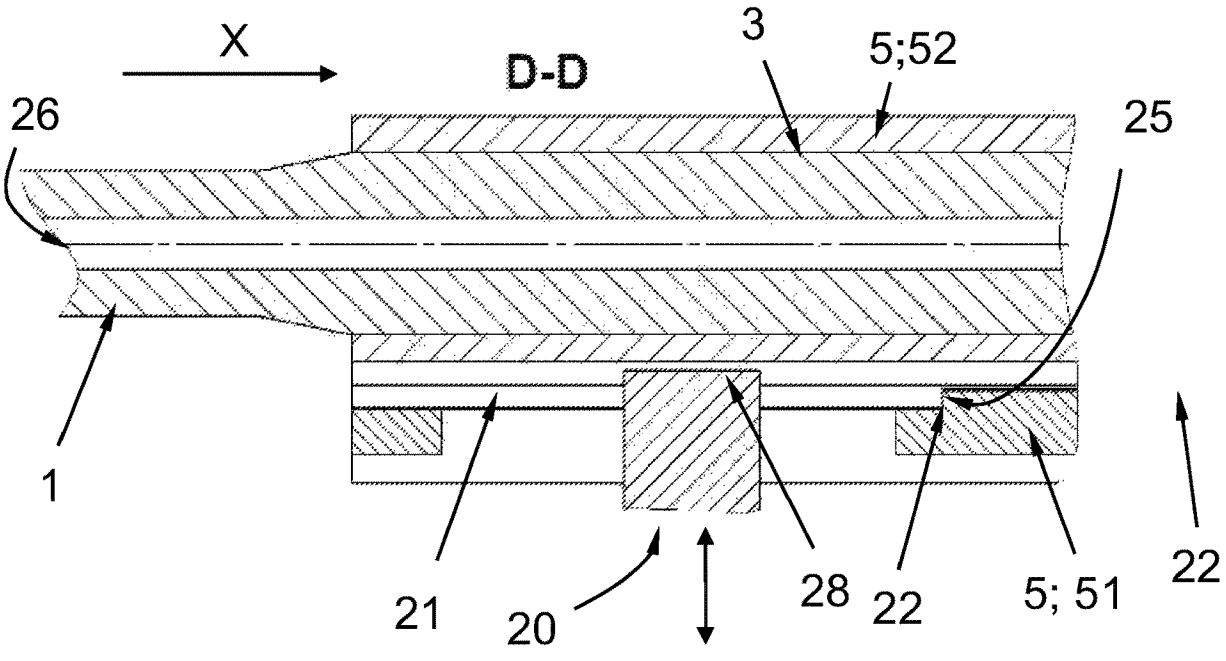
FIG. 9 is a cross-sectional view of a firearm according to the present disclosure, as indicated in FIG. 10.

FIG. 9 shows another possible variant, in which the tensioning element 20 is in the form of a hook such that a pin or an undercut (as shown in FIG. 10) engages behind the guide 6 and pulls the barrel 1 downwards together with the locking bush 3. In turn, fastening is carried out by a tensioning element 20 or tensioning portion 28 (not shown in more detail in FIGS. 9 and 10) centering on the guide surfaces 23 in a similar way to in the above-described examples. In this variant, the centering element 21 is also divided into two sub-elements 21*a*, 21*b*, which are formed such that their shape and function is complementary to that of the guide surfaces 23 on the upper side of the locking bush 3.

A tensioning portion 28 formed in accordance with the disclosure can be formed as a cam as shown in FIGS. 3-4 and 7-8, whereby a design as an eccentric element or wedge is also conceivable in order to exert a pressure on the locking bush 3 and/or the barrel 1. Similarly, a tensioning portion 28, as shown in FIGS. 5-6 and 9-10, can preferably be formed as a claw-shaped or hook-shaped gripping element, whereby variations are likewise conceivable, such as having a trapezoidal cross section in order to engage in undercuts.

Figures 11A, 11B:
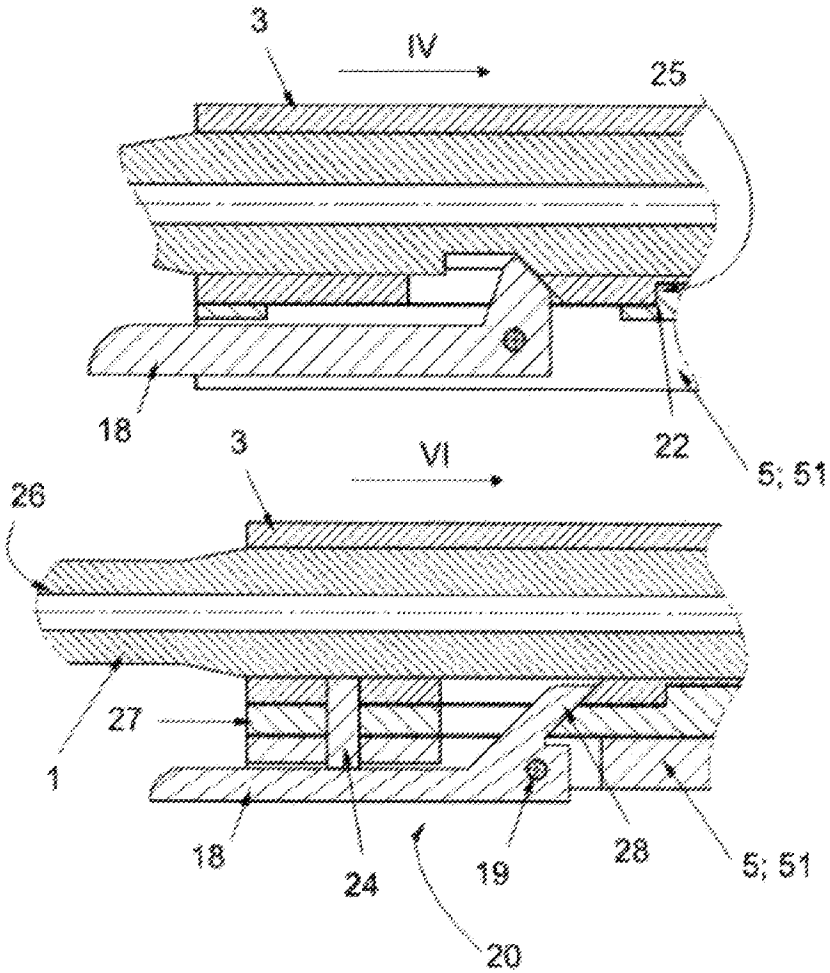
FIGS. 11A and 11B are purely schematic views of a detail of a firearm according to the present disclosure.

It is clear to a person skilled in the art on the basis of the embodiments discussed above that, as shown in FIGS. 11A and 11B, the barrel 1 and optionally the locking bush 3 can additionally be axially secured by means of oblique surfaces on the carrier 5 or the upper housing 4 in the operating region of the tensioning portion 28, which surfaces are targetedly adapted to one another, such as by an angle of attack of from 1° up to approximately 30°.

As FIG. 2-10 very clearly show, by positioning the barrel 1 inside the upper housing 4 by means of a tensioning element 20, as per the disclosure, it is possible that the barrel and/or caliber can be quickly changed with repetition accuracy. In addition, the actuation of the tensioning element 20 by means of the actuating portion 18 about a center of rotation 19 allows the firearm to only be ready to fire after the tensioning portion 28 is "active", i.e. actuated, and therefore the barrel 1 and/or the locking bush 3 is/are rigidly connected to the upper housing 4. In comparison to well-known barrel changing systems, in which the barrel is screwed down, for example, or in systems secured by a cap nut on the upper housing 4, the solution according to the disclosure can prevent the barrel from being inadequately secured, or not being secured at all.

In another embodiment, securing of the barrel 1 as per the disclosure involves at least one spring element 29, which engages on or inside the tensioning element 20 and pretensions the tensioning portion 28 relative to the barrel 1 and/or the locking bush 3 and/or the intermediate piece 27. By using a spring element having a sufficiently high pretensioning force, any signs of wear on the tensioning portion 28 can be compensated for in the closed position or manufacturing tolerances can be equalized. The spring element 29 can be formed as both a pressure spring and a tension spring.

Figure 12:
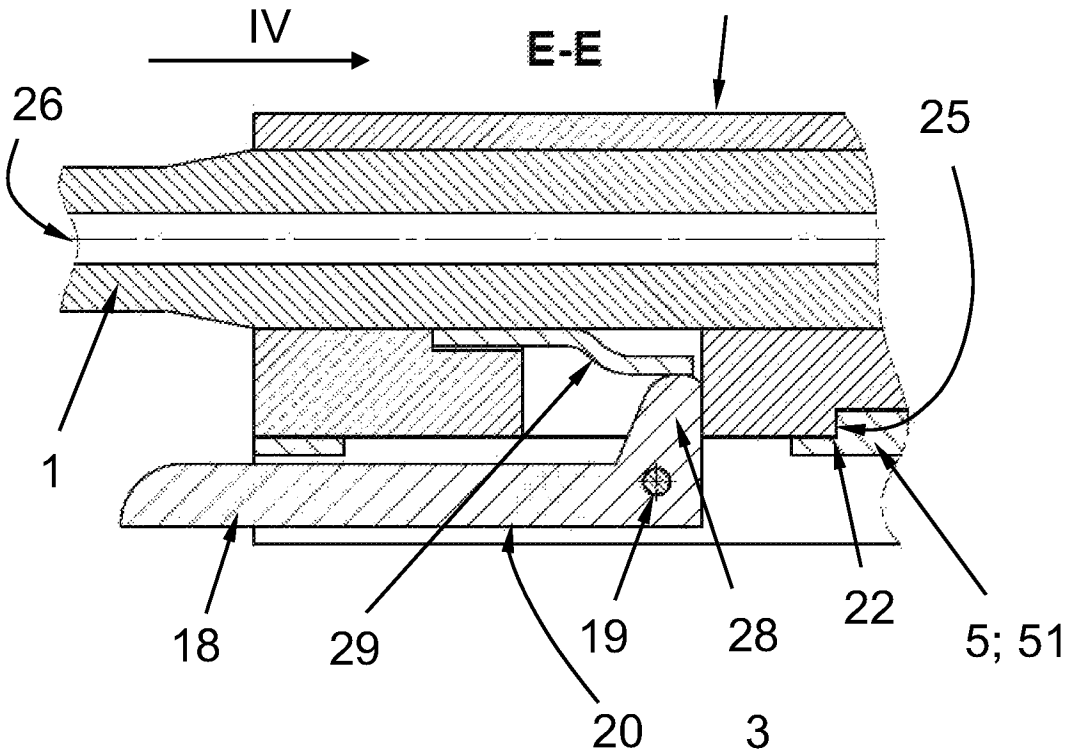
FIG. 12 is a cross-sectional view of a firearm according to the present disclosure, showing a variation of the firearm shown in FIG. 3.
Figure 13:
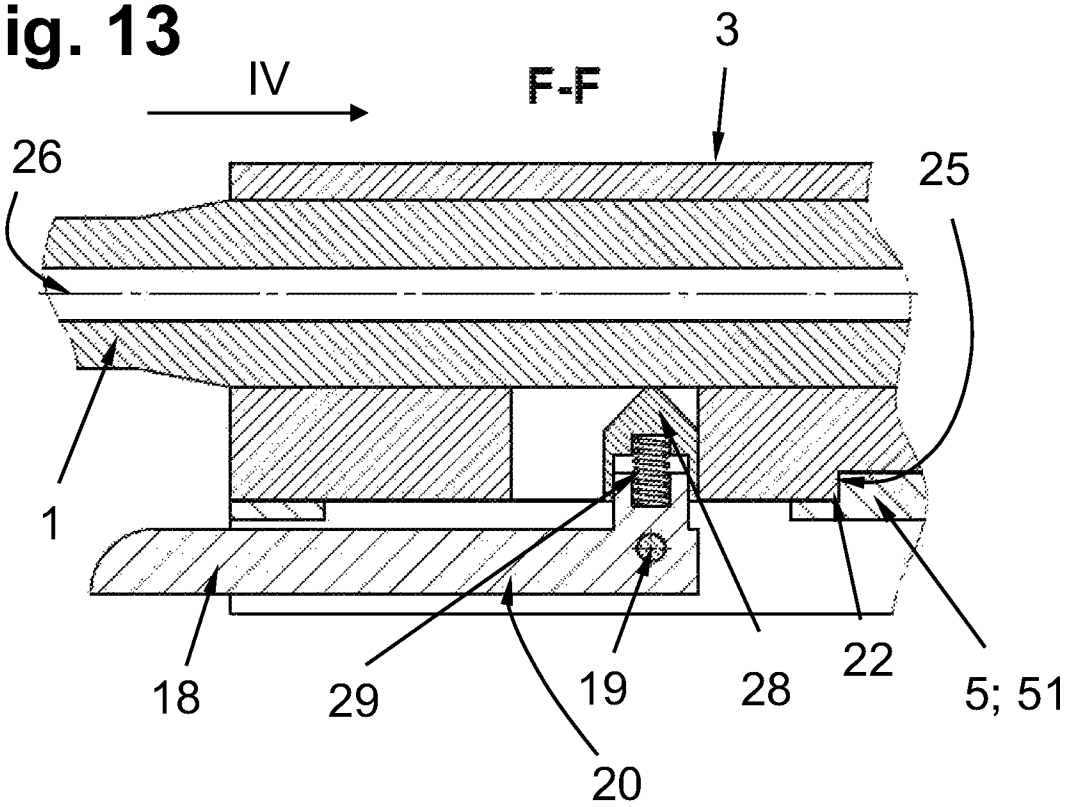
FIG. 13 is a cross-sectional view of a firearm according to the present disclosure, showing a variation of the firearm shown in FIG. 3.
Figure 14:
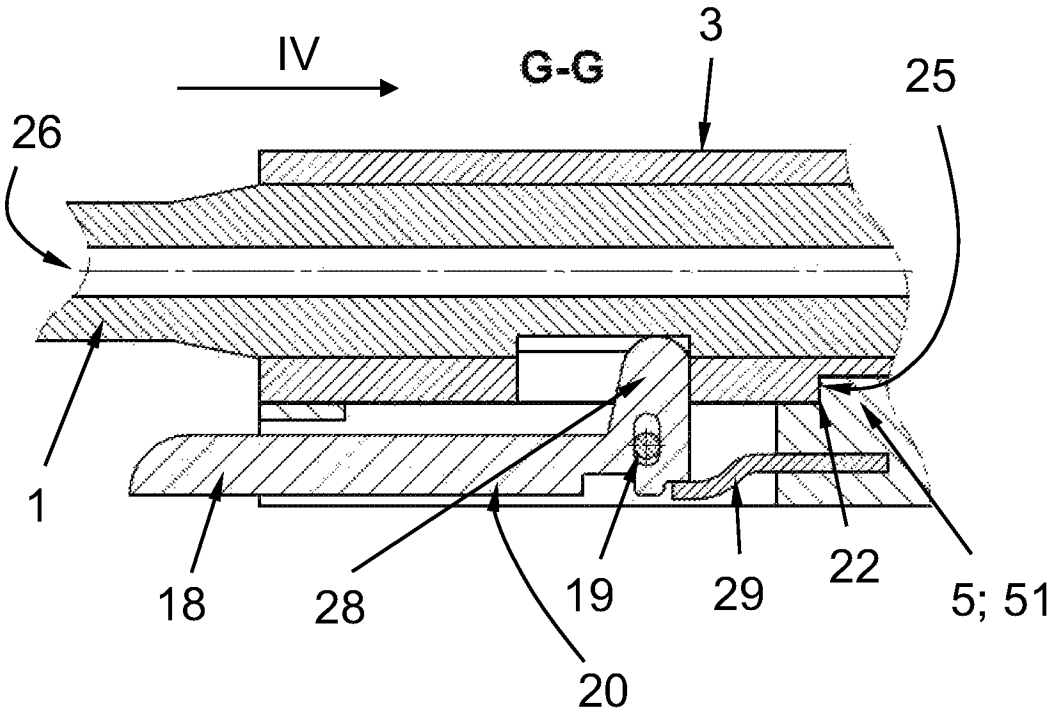
FIG. 14 is a cross-sectional view of a firearm according to the present disclosure, showing a variation of the firearm shown in FIG. 3.

FIG. 12-14 show possible embodiments, whereby the spring element 29 is formed as a pressure spring and interacts with the tensioning portion 28. The corresponding front views of the sectional views are shown in FIG. 4 analogously to FIG. 3.

In FIG. 12, the spring element is arranged between the locking bush 3 and the barrel 1 by way of example, an alternative arrangement also being conceivable, such as exclusively inside the locking bush 3.

FIG. 13 shows a variant in which the spring element 29 is arranged hidden inside the tensioning portion 28 in order to exert the compressive force, the contact surface at the end of the tensioning portion, which surface faces the barrel, not having to have the form shown.

FIG. 14 is a schematic view of another possible embodiment, whereby, in the region of the axis of rotation 19, the tensioning element 20 comprises an elongate hole that is normal with respect to the firearm center plane and comprises a longitudinal extension that is normal with respect to the barrel shaft and the spring element 29 engages on the tensioning element 20 from the outside. It is clear from this view that the tensioning element 20 can move against the spring force a limited route that is normal with respect to the barrel shaft 26. As a result, the tensioning element 20 can be opened and closed, and a preset compressive force is applied to the tensioning portion 28 in the closed position. An axial deflection in the direction of the barrel shaft 26 is avoided, as a result of which the barrel 1 and/or the locking bush 3 can be axially secured in a manner consistent with the above-mentioned embodiments.

Figure 15:
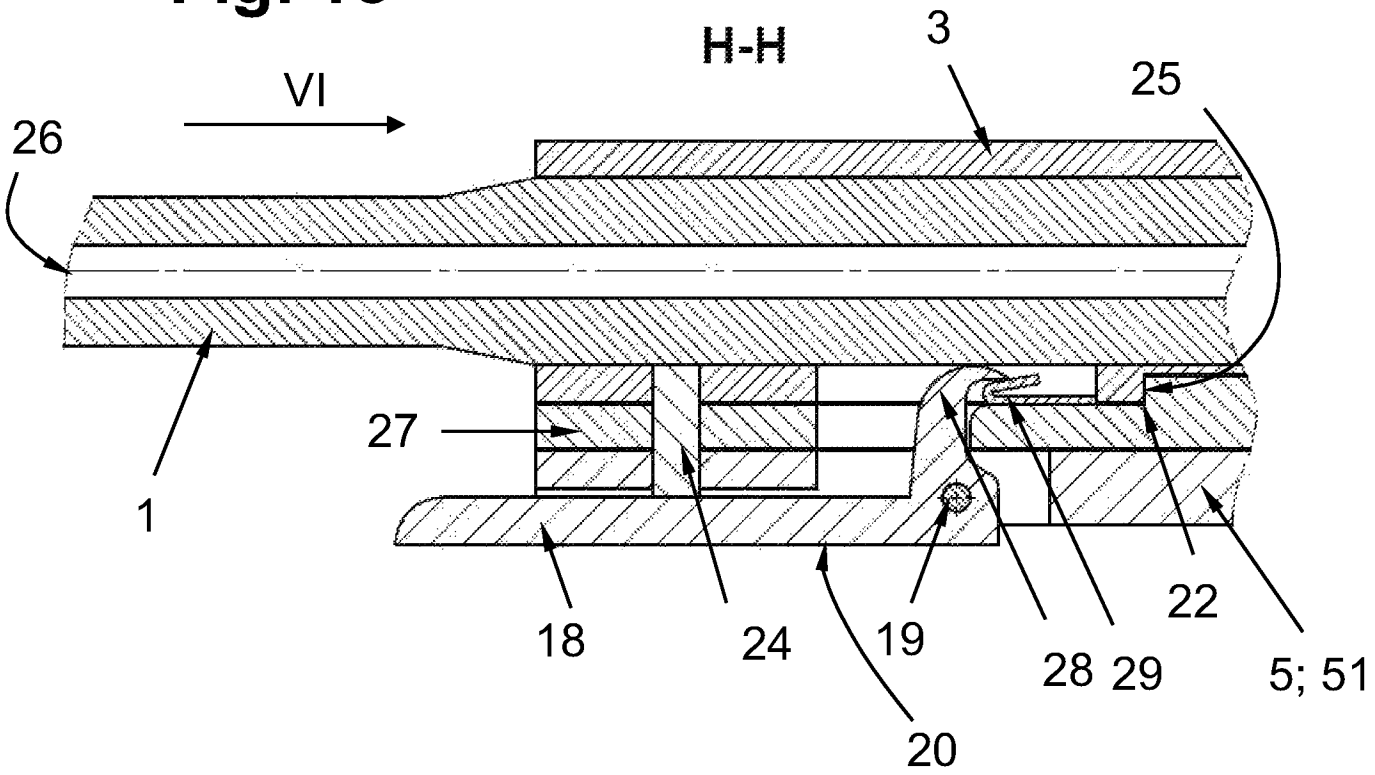
FIG. 15 is a cross-sectional view of a firearm according to the present disclosure, showing a variation of the firearm shown in FIG. 3.
Figure 16:
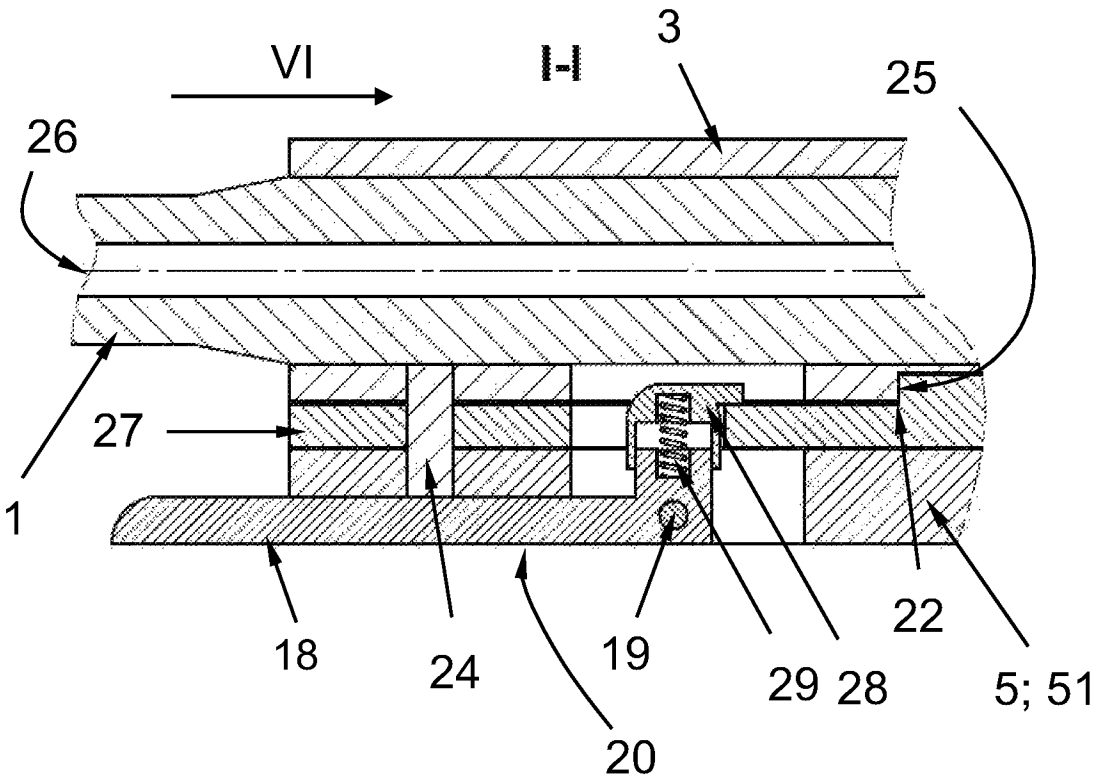
FIG. 16 is a cross-sectional view of a firearm according to the present disclosure, showing a variation of the firearm shown in FIG. 3.

FIG. 15-16 show possible embodiments in which the tensioning element 20 or the tensioning portion 28 are pretensioned by means of the spring element 29 under tensile stress. By viewing FIG. 15-16 together with FIG. 5, it can clearly be seen that the spring element 29 in FIG. 15 can be arranged such that the intermediate piece 27 and therefore the locking bush 3 can be rigidly pretensioned with the upper housing 4 by means of the support 5, thereby ensuring a rigid and reproducible seat of the barrel 1.

FIG. 16 indicates another variant in which the spring element 29 is arranged inside the tensioning element 20. In the schematic view, pretension and a force are once again applied normally with respect to the barrel shaft 26 by the tensioning portion 28 in the closed position. In addition, clamping takes place in the axial direction similarly to in the above-mentioned examples.

The following numbered paragraphs describe selected additional aspects and features of the firearms of the present disclosure. Each of these paragraphs can be combined with one or more other paragraphs, and/or with disclosure from elsewhere in this application, including materials incorporated by reference, in any suitable manner. Some of the paragraphs below expressly refer to and further limit other paragraphs, providing without limitation examples of some of the suitable combinations.

A1. A firearm, in particular a rifle, comprising an upper housing (4) and a lower housing (10), the upper housing containing at least one barrel (1) comprising a barrel shaft (26), optionally comprising a locking bush (3) that is rigidly connected to said shaft, a bolt mechanism (7), a firing pin mechanism, optionally a gas mechanism (2) and a cover, the lower housing (10) containing at least one butt (13), a magazine (16) and a trigger mechanism (12), the upper housing (4) and the lower housing (10) being interconnected in the assembled ready-to-fire state and the trigger mechanism (12) being operatively connected to the firing pin mechanism, and the barrel (1) being detachably arranged in the upper housing (4), characterized in that the barrel (1), optionally the locking bush (3) thereof, and a carrier (5), optionally directly the upper housing (4), are interconnected by means of a guide (6), in that the guide (6) comprises prismatic guide surfaces (23), which extend in parallel with the barrel shaft (26) when the firearm is mounted and ready to fire, in that the barrel (1) is secured to the upper housing (4) by means of a tensioning element (20) that can rotate in the upper housing about an axis of rotation (19), which extends normally with respect to the firearm center plane, between two end positions, the ready-to-fire position and the disassembled position, optionally cams, comprising a tensioning portion (28) and an actuating portion (18), and in that, in the ready-to-fire position, the tensioning portion (28) rests against a stop surface (22) of the barrel (1) or the locking bush (3) thereof and, in the fieldstripped position, the tensioning portion (28), optionally the cam, lies entirely outside the motion path of the barrel (1), optionally also the locking bush (3) thereof.

A2. The firearm as per paragraph A1, characterized in that the carrier (5) or optionally the upper housing (4) comprises an axial stop surface (22) for supporting the locking bush (3) and/or the barrel (1).

A3. The firearm, in particular rifle, as per either paragraph A1 or paragraph A2, characterized in that the guide (6) is at least one dovetail guide.

A4. The firearm as per any one of the preceding paragraphs, characterized in that the guide (6) comprises at least two divided centering elements (21*a*, 21*b*) and therefore guide surfaces (23) that interact.

A5. The firearm, in particular a rifle, as per any one of the preceding paragraphs, characterized in that, when the tensioning element (20) is in the ready-to-fire position, the tensioning part (28), optionally the cam, exerts a force on the barrel (1), optionally the locking bush (3) thereof, which force is oriented in the firearm center plane and normally with respect to the barrel shaft (26).

A6. The firearm, in particular rifle, as per any one of the preceding paragraphs, characterized in that the guide (6) is symmetrical to the firearm center plane.

A7. The firearm as per any one of the preceding paragraphs, characterized in that the lower side of the barrel (1) comprises a flat portion for receiving and supporting the tensioning portion (28).

A8. The firearm as per any one of the preceding paragraphs, characterized in that the lower side of the barrel (1) comprises a recess for receiving and supporting the tensioning portion (28), and in that the lower side of the locking bush (3), where provided, comprises a through-opening for the tensioning portion (28) that is substantially the same size as the recess.

A9. The firearm as per any one of the preceding paragraphs, characterized in that the barrel (1) is releasably connected, preferably screwed, to the locking bush (3).

A10. The firearm as per any one of the preceding paragraphs, characterized in that the carrier (5) is integral with the upper housing (4).

A11. The firearm as per any one of the preceding paragraphs, characterized in that the tensioning portion (28) is in the form of a cam.

A12. The firearm as per any one of the preceding paragraphs, characterized in that a spring element (29) is arranged such that, in the closed state, the actuating portion (28) can be moved by means of a pretensioning force that is substantially normal with respect to the barrel shaft (26).

A13. The firearm as per paragraph 12, characterized in that the spring element (29) is arranged between the barrel (1) and/or the locking bush (3) and the tensioning portion (28).

A14. The firearm as per paragraph 12, characterized in that a spring element (29) is formed substantially inside the tensioning element (20), preferably inside the tensioning portion (28).

The disclosure can have various modifications and designs, in particular the proportions of the individual components described can be adapted to match the respective specifications of the firearm.

In the description and the claims, the terms "front", "back", "above" and "below" and so on are used in the conventional sense and with reference to the object in its normal operating position.

This means that, in the firearm, the muzzle of the barrel is at the "front", that the bolt or slide is moved "backwards" as a result of the explosive gases, etc. "Transversely to a direction" substantially means a direction rotated by 90°.

Statements such as "lower region" of a component or a device or, in general, an object, means the bottom half and in particular the bottom quarter of the overall weight, "bottommost region" means the bottommost quarter and in particular an even smaller part; whilst "central region" means the middle third of the overall height (or width-length). All of these statements have their conventional meaning when applied to the intended position of the object shown.

In the description and the claims, "substantially" means a deviation of up to 10% of the stated value both downwards and upwards, if physically possible, and otherwise only in the sensible direction; for degrees (angles and temperatures), ±10° is therefore meant.

All the stated amounts and proportions, in particular those that delimit the disclosure, provided they do not relate to the specific examples, are to be understood with a ±10% tolerance, therefore for example: 11% means: from 9.9% to 12.1%. For designations such as: "a solvent", the word "a" should not be considered to be a numeral, but an indefinite article or a pronoun, unless the context suggests otherwise.

Unless otherwise stated, the term "combination" or "combinations" means all types of combinations, starting from two of the constituents in question up to a plurality or even all of said constituents; the term: "containing" also means "consisting of". Statements such as: "more than three . . . " also comprise and disclose any single number that is greater than three.

The features and variants set out in the individual embodiments and examples can be freely combined with those of other examples and embodiments and can be used in particular to characterize the disclosure in the claims, without having to include the other details of the particular embodiment or particular example.

List of reference numerals

| | |
|---|---|
| 01 | barrel |
| 02 | gas drive |
| 03 | locking bush |
| 04 | upper housing (upper) |
| 05 | carrier |
| | 51 carrier plate |
| | 52 carrier frame |
| 06 | guide elements |
| 07 | bolt unit |
| 08 | cocking slide unit |
| 09 | fore-end |
| 10 | lower housing (lower) |
| 11 | magazine holder |
| 12 | trigger unit |
| 13 | butt |
| 14 | slide stop device |
| 15 | central lock |
| 16 | magazine |
| 17 | stock |
| 18 | actuating portion |
| 19 | axis of rotation |
| 20 | tensioning element |
| 21 | centering element |
| 22 | axial stop, axial stop surface |
| 23 | guide(s), guide surface(s) |
| 24 | counter pusher |
| 25 | front side |
| 26 | barrel shaft |
| 27 | intermediate piece (element) |
| 28 | tensioning portion |
| 29 | spring element |
| 30 | firearm center plane |

The invention claimed is:

1. A firearm, comprising:

an upper housing, the upper housing including at least one barrel having a barrel shaft, a bolt mechanism, a firing pin mechanism, and a cover; and a lower housing, the lower housing including at least one butt, a magazine, and a trigger mechanism;

such that when the firearm is in an assembled and ready-to-fire state the upper housing and the lower housing are interconnected, the trigger mechanism is operatively connected to the firing pin mechanism, and the barrel is detachably arranged in the upper housing;

provided that the barrel and a carrier are interconnected by means of a guide having prismatic guide surfaces that extend in parallel with the barrel shaft when the firearm is mounted in the ready-to-fire state;

further provided that the barrel is secured to the upper housing by means of a tensioning element that can rotate in the upper housing between a first end position that is a ready-to-fire position and a second end position that is a disassembled position, the tensioning element rotating about an axis of rotation that extends orthogonally with respect to a center plane of the firearm; and yet further provided that when the firearm is in the ready-to-fire state, a tensioning portion of the tensioning element rests against a stop surface of the barrel, and when the firearm is in a fieldstripped position, the tensioning portion of the tensioning element lies entirely outside a motion path of the barrel such that the barrel can slide parallel to and in contact with the prismatic guide surfaces to disassemble the barrel from the carrier.

2. The firearm of claim 1, wherein the upper housing further comprises a gas-operated reloading mechanism.

3. The firearm of claim 1, wherein when the firearm is in an assembled and ready-to-fire state the barrel, the carrier, and the upper housing are interconnected by the guide.

4. The firearm of claim 1, wherein the guide is symmetrical to a center plane of the firearm.

5. The firearm of claim 1, wherein a lower side of the barrel includes a flat portion configured to receive and support the tensioning portion.

6. The firearm of claim 1, wherein the carrier is integral with the upper housing.

7. The firearm of claim 1, wherein the guide includes at least one dovetail guide.

8. The firearm of claim 1, wherein the guide includes at least two divided centering elements having a complementary shape and function to the prismatic guide surfaces with which they interact.

9. The firearm of claim 1, wherein when the tensioning element is in the ready-to-fire position, the tensioning portion exerts a force on the barrel that is oriented within the center plane of the firearm and orthogonal with respect to the barrel shaft.

10. The firearm of claim 1, wherein the tensioning portion of the tensioning element includes a cam.

11. The firearm of claim 10, wherein when the tensioning element is in the ready-to-fire position, the cam exerts a force on the barrel that is oriented within the center plane of the firearm and orthogonal with respect to the barrel shaft.

12. The firearm of claim 10, wherein the cam of the tensioning element includes the tensioning portion and an actuating portion, and when the firearm is in a fieldstripped position, the cam lies entirely outside the motion path of the barrel.

13. The firearm of claim 1, wherein the upper housing further comprises a locking bush that is rigidly connected to the barrel shaft, such that when the firearm is in the assembled and ready-to-fire state the barrel, the locking bush, and the carrier are interconnected by the guide.

14. The firearm of claim 13, wherein the barrel is releasably connected to the locking bush.

15. The firearm of claim 13, wherein the barrel is screwed to the locking bush.

16. The firearm of claim 13, wherein when the firearm is in the ready-to-fire state, the tensioning portion of the tensioning element rests against the locking bush, and when the firearm is in the fieldstripped position, the locking bush lies entirely outside the motion path of the barrel.

17. The firearm of claim 13, wherein one of the carrier or the upper housing includes an axial stop surface for supporting the locking bush and/or the barrel.

18. The firearm of claim 13, wherein a lower side of the barrel includes a recess for receiving and supporting the tensioning portion, and a lower side of the locking bush includes a through-opening for the tensioning portion that is substantially the same size as the recess.

19. The firearm of claim 13, further comprising a spring element that is arranged between the barrel and/or the locking bush and the tensioning portion of the tensioning element.

20. The firearm of claim 1, wherein the tensioning element includes a cam that includes the tensioning portion and an actuating portion, the firearm further comprising a spring element that is arranged so that when the spring element is in a closed state, the actuating portion can be moved by a pretensioning force that is substantially normal with respect to the barrel shaft.

21. The firearm of claim 20, wherein the spring element is formed substantially inside the tensioning element.

22. The firearm of claim 20, wherein the spring element is formed substantially inside the tensioning portion of the tensioning element.

23. The firearm of claim 1, wherein the upper housing further comprises a locking bush that is rigidly connected to the barrel shaft, and the tensioning portion of the tensioning element includes a cam, such that when the tensioning element is in the ready-to-fire position, the cam exerts a force on the locking bush that is oriented within the center plane of the firearm and orthogonal with respect to the barrel shaft.

* * * * *